United States Patent [19]

Klaila

[11] Patent Number: 4,512,574

[45] Date of Patent: Apr. 23, 1985

[54] RACKET HAVING A REFRIGERANT CONTAINED THEREIN FOR HEAT DISSIPATION

[76] Inventor: William J. Klaila, 399 Marion Rd., Middleboro, Mass. 02346

[21] Appl. No.: 419,777

[22] Filed: Sep. 20, 1982

[51] Int. Cl.[3] ..... A63B 49/00

[52] U.S. Cl. ..... 273/73 J

[58] Field of Search ..... 273/73 R, 67 R, 81 R, 273/73 J, 75, 73 C; 165/147, 104.21; 62/119, 259.3; 128/402

[56] References Cited

U.S. PATENT DOCUMENTS

| | | | |
|---|---|---|---|
| 879,477 | 2/1908 | Kruger | 273/73 J |
| 3,738,702 | 6/1973 | Jacobs | 165/104.21 X |
| 3,837,394 | 9/1974 | Roberts | 165/104.21 X |
| 3,907,292 | 9/1975 | Moreland | 273/73 C |

FOREIGN PATENT DOCUMENTS

| | | | |
|---|---|---|---|
| 407983 | 3/1934 | United Kingdom | 273/73 J |

*Primary Examiner*—Richard C. Pinkham
*Assistant Examiner*—Matthew L. Schneider
*Attorney, Agent, or Firm*—Herbert L. Bello

[57] ABSTRACT

A sporting implement and more specifically, a racket. The racket has a frame connected to a handle and a tubular member disposed about the frame and handle. A liquid refrigerant located in the tubular member serves to dissipate heat generated by the user's hand. The tubular member has portions which define an evaporator and a condenser such that heat from the user's hand evaporates the refrigerant and the evaporated refrigerant travels to the condensing area where it changes back to a liquid state.

8 Claims, 3 Drawing Figures

RACKET HAVING A REFRIGERANT CONTAINED THEREIN FOR HEAT DISSIPATION

BACKGROUND OF THE INVENTION

1. Field of the Invention:

The present invention relates to cooling devices and, more particularly, relates to devices for dissipating body heat.

2. Description of the Prior Art:

When an individual begins to exercise, heat dissipating mechanisms within the body limit the rise in body temperature. Without these mechanisms, body temperature rises approximately 1° C. every five to eight minutes. Such an uncontrolled rise in body temperature would limit exercise to relatively short periods of time.

Transfer of heat from the skin to the environment can occur by convection, radiation and evaporation. In a warm or hot environment, convective and radiative pathways are not available for heat dissipation. If the rate of heat dissipation does not balance the rate of heat production, the body stores the excess heat and body temperature continues to rise as long as exercise is continued. A need has arisen for non-biological devices for dissipating body heat.

SUMMARY OF THE INVENTION

An object of the present invention is to provide a device for dissipating body heat.

Another object of the present invention is to provide a device for limiting the rise in body temperature.

A further object of the present invention is to provide a hand held device for dissipating body heat during periods of exercise and work. The invention is characterized by a body heat dissipater in the form of a hand held device used to participate in a sport or in the form of a tool. The heat dissipating device includes a handle, a head and a heat exchanger. The heat exchanger is an evacuated tubular member which extends between the handle and head and defines an evaporator and a condenser, a liquid refrigerant being contained within the tubular member. Wheh the dissipater is held by the handle a thermal path is established between the person and the evaporator. The temperature rise in those portions of the body which are in thermal contact with the handle is controlled through vaporization of the refrigerant, body heat being transferred to the refrigerant in the evaporator portion of the tubular member. Vaporized fluid in the evaporator is cooled in the condenser and condenses back to liquid form, cooling being enhanced by movement of the heat dissipating device.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

The invention is characterized by a hand held appliance 10 for dissipating body heat and controlling the rise in body temperature. In the illustrated embodiment, body heat dissipater 10 is in the form of a tennis racket. It is to be understood that in alternate embodiments, body heat dissipater is other than a tennis racket, for example any appliance used to participate in a sport such as a bat or a raquetball racket or the like or any hand held tool such as a hammer or an axe or the like.

Figure 1:
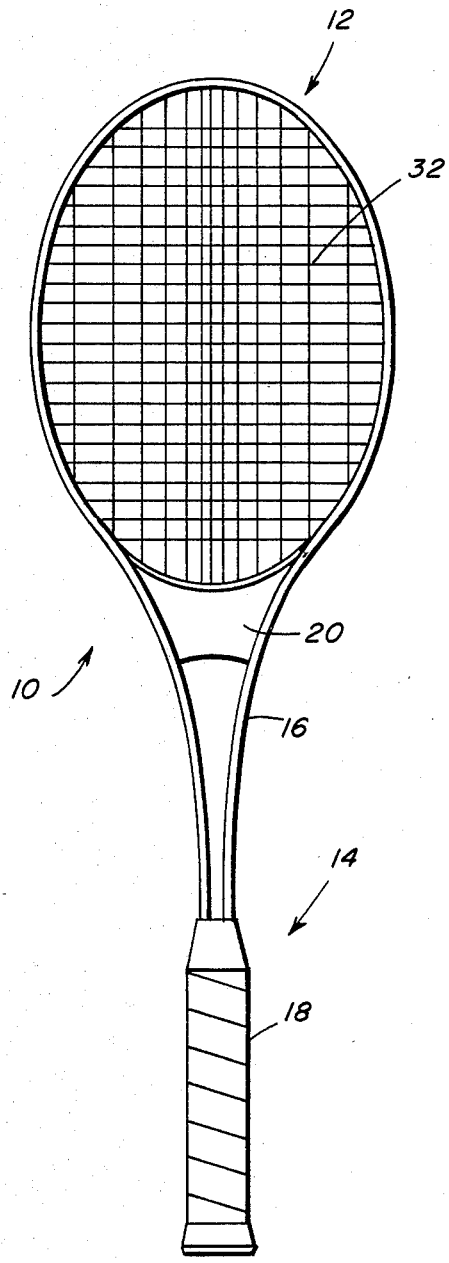
FIG. 1 is a front view of a body heat dissipater in the form of a tennis racket embodying the invention.
Figure 2:
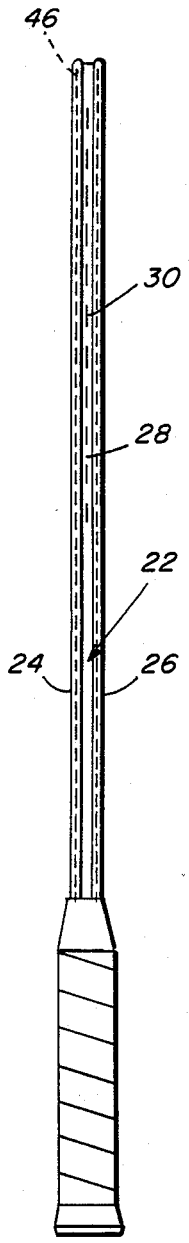
FIG. 2 is a side elevation of the tennis racket of FIG. 1 showing a pair of sealed chambers.

Referring now to the drawings, particularly FIG. 1, it will be seen that tennis racket 10 includes a head 12, a handle shaft 14 and a frame 16. The frame 16, which preferably is made from a hollow extruded high strength aluminum alloy, is bent into the desired configuration so as to have a loop defining the head 12 and parallel ends which are secured to a handle grip 18. The grip 18 is fabricated of a lightweight heat conducting material such as metal impregnated plastic, for example polyvinyldine flouride, with a perforated leather covering, a metal thread and fabric covering or other suitable covering. The grip 18 is made in a variety of sizes for different player preferences. The racket 10 includes a throat 20 which is secured within frame 16 to provide a suitable lower completion of the generally elliptical strung surface. Throat 20 is pierced with holes which match holes in the frame 16 to provide the basis for accomplishing a stringing pattern. The throat 20 may be made from a high strength polymeric plastic material.

Frame 16 has a central channel 22 which is bounded by a pair of tubular members 24 and 26, the tubular members following the periphery of head 12 and extending into handle grip 18. Channel 22, which is formed on the outer periphery of frame 16, may be provided with a grommet strip 28 having grommets 30 integral therewith. Grommets 30 extend through holes in the frame 16 whereby strings 32 may be threaded through adjacent grommets and partially extend around grommet strip 28.

Figure 3:
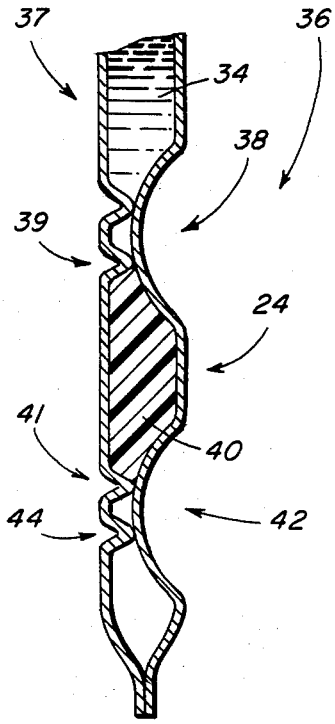
FIG. 3 is an enlarged view of the sealed section of the tennis racket of FIG. 2.

According to the teachings of the present invention, each tubular member 24 and 26 contains a refrigerant 34, for example a liquid refrigerant such as R-11. Tubular members 24 and 26 may be filled with refrigerant 34 using various techniques. In one example, tubular members 24 and 26 are filled with refrigerant 34 and then evacuated and sealed. In one embodiment of the invention, tubular members 24 and 26 are filled in the manner hereinafter described. Since the tubular members 24 and 26 are filled with refrigerant 34 and sealed in the same manner, reference is made only to the filling and sealing of tubular member 24. Initially, one of the opened ends of tubular member 24 is sealed, preferably with a two-pinch double seal 36 of the type shown in FIG. 3. A first seal 37 of double seal 36 is made using a suitable tool. One side of tubular member 24 is bent inwardly to form a shallow cup 38 and the opposite side of tubular member 24 is formed with a pair of adjacent V grooves 39. Next, a sealing compound 40, for example a silicone sealant, is inserted into the opened end of tubular member 24. Next, a second seal 41 of the double seal 36 is formed between the opened end of tubular member 24 and silicone sealant 40. That is, tubular member 24 is pinched closed at its opened end to form a shallow cup 42 and a pair of adjacent V grooves 44. Silicone sealant 40 is trapped between the first seal 37 and the second seal 41 of the double seal 36. Next, refrigerant 34 is poured into the opened end of tubular member 24. Then, tubular member 24 is evacuated. Finally, the open end of tubular member 24 is sealed with a two-pinch double seal in the same manner as the other end. Tubular member 26 is provided with refrigerant 34 and sealed in the same manner described in connection with tubular member 24. Tubular members 24 and 26 are composed of a material which is sufficiently flexible so that they can be bent in the desired shape and sufficiently rigid so that they do not collapse when the tubular members are evacuated. In the preferred embodiment, tubular members 24 and 26 are evacuated to approximately five to ten inches of mercury. In another example, tubular members 24 and 26 are evacuated until the liquid refrigerant 34 appears at the opened end. When the refrigerant 34 appears, the opened end of the appropriate tubular member 24, 26 being filled is sealed. Although, in the illustrated embodiment, each seal of the double seals is provided with two V grooves, it is to be understood that other seal configurations can be used. However, a double seal with a sealant trapped between each of the seals is preferred over a single seal.

It will be readily appreciated that tennis racket 10 defines a heat dissipating device in which head 12 defines a condenser and handle 14 defines an evaporator, a thermal path being established between the user's hand and the evaporator. Body heat, which is believed to be greatest at the point of most activity, particularly the arm holding racket 10, is transferred to handle 14. Refrigerant 34 in tubular members 24 and 26 is heated by the transfer of body heat and begins to boil and vaporize. The vaporized refrigerant 34 in handle 14 travels towards head 12 and releases heat along the way. The vaporized refrigerant 34 condenses back to its fluid state in condenser 12 and returns to handle 14 where the cycle is continuously repeated to effect rapid heat removal from the hand grasping the racket 10. The swinging of the racket 10 increases the rate at which the vaporized fluid condenses back to its fluid state. That is, by using tennis racket 10 in the normal manner, the cooling rate is greatly increased. Also, in one embodiment of the invention, tubular members 24 and 26 are lined internally with a wick 46, for example a fiberglass cloth, which aids in the return of the condensed fluid from head 12 to handle 14.

Although the invention was shown in the form of a tennis racket, it is to be understood that other types of sporting equipment could be used, for example, baseball bats, raquetball rackets, badminton rackets and the like. In addition, the invention is applicable to various types of hand tools such as axes, hammers and the like.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A body heat dissipating tennis racket comprising:
(a) a head;
(b) a handle, said head and handle being interconnected;
(c) a tubular member disposed about the periphery of said head and extending into said handle; and
(d) a refrigerant contained within said tubular member, said refrigerant having the property of changing phase when subjected to the body heat of a person holding said handle.

2. A hand held device for dissipating body heat, said device comprising:
(a) a frame having a handle;
(b) at least one tubular member disposed about portions of said frame, said tubular member extending into said handle; and
(c) a refrigerant within said tubular member, said tubular member defining an evaporator and a condenser.

3. The device as claimed in claim 2 including wick means disposed within said tubular member.

4. A device for dissipating body heat comprising:
(a) a tennis racket having a chamber, said chamber defining an evaporator and a condenser;
(b) a refrigerant sealed within said chamber; and
(c) means on said tennis racket for establishing a thermal path between a selected body portion of a person using said tennis racket and said refrigerant.

5. The device as claimed in claim 4 wherein said tennis racket includes a handle, a head and a tubular member, said chamber being formed within said tubular member which is disposed along the periphery of said head, said tubular member extending into said handle.

6. The device as claimed in claim 5 wherein said refrigerant is a liquid refrigerant, said refrigerant being contained within said tubular member.

7. The device as claimed in claim 6 wherein said chamber is evacuated.

8. A body heat dissipating tennis racket comprising:
(a) a head;
(b) a handle, said head and handle being interconnected;
(c) an evacuated tubular member disposed about the periphery of said head and extending into said handle; and
(d) a liquid refrigerant contained within said tubular member.

* * * * *